US006493530B2

(12) United States Patent
Ishii et al.

(10) Patent No.: US 6,493,530 B2
(45) Date of Patent: Dec. 10, 2002

(54) METHOD FOR CONTROLLING DENSITY OF LIQUID CARRIER IN THE TONER IMAGES

(75) Inventors: Koichi Ishii, Kanagawa-ken (JP); Haruhi Ooka, Kanagawa-ken (JP)

(73) Assignee: Kabushiki Kaisha Toshibia, Tokyo (JP)

( * ) Notice: Subject to any disclaimer, the term of this patent is extended or adjusted under 35 U.S.C. 154(b) by 0 days.

(21) Appl. No.: 09/963,535

(22) Filed: Sep. 27, 2001

(65) Prior Publication Data

US 2002/0067931 A1 Jun. 6, 2002

(30) Foreign Application Priority Data

Sep. 27, 2000 (JP) ..... 2000-295271

(51) Int. Cl.[7] ..... G03G 9/08; G03G 15/10

(52) U.S. Cl. ..... 399/237; 399/233; 399/249; 430/119

(58) Field of Search ..... 399/237, 239, 399/249, 233; 430/117, 119

(56) References Cited

U.S. PATENT DOCUMENTS

| | | | | |
|---|---|---|---|---|
| 4,181,094 A | * | 1/1980 | Gardiner | 399/249 |
| 4,600,669 A | | 7/1986 | Ng et al. | 430/47 |
| 4,728,983 A | | 3/1988 | Zwadlo et al. | 349/119 |
| 5,276,492 A | | 1/1994 | Landa et al. | 399/249 |
| 5,408,299 A | | 4/1995 | Haas | 399/233 |
| 5,426,491 A | * | 6/1995 | Landa et al. | 399/237 |
| 5,570,173 A | | 10/1996 | Nye et al. | 399/237 |
| 6,072,972 A | * | 6/2000 | Obu et al. | 399/237 |
| 6,141,517 A | * | 10/2000 | Kuramochi et al. | 399/237 X |
| 6,198,894 B1 | * | 3/2001 | Park | 399/249 |

FOREIGN PATENT DOCUMENTS

JP 58-66953 4/1983

* cited by examiner

*Primary Examiner*—Fred L' Braun
(74) *Attorney, Agent, or Firm*—Oblon, Spivak, McClelland, Maier & Neustadt, P.C.

(57) ABSTRACT

Method of a liquid process type electrophotographic apparatus forming a multicolor visible image on a surface of a photosensitive drum, which prevents the visible image after the second color from being disturbed. After a visible image of the first color has been formed with a development unit on a surface of a photosensitive drum, a part of liquid carrier existing on the surface of the photosensitive drum is removed by using a squeeze roller and an air blower. When an electrostatic latent image is formed with a charger 1 and an exposing unit on the photosensitive drum where the visible image of the first color has been formed, disturbance of the electrostatic latent image caused by a large amount of liquid carrier or lack of liquid carrier can be reduced by reserving a predetermined very small amount of liquid carrier, and disturbance of a visible image of the second color to be developed by a development unit can be reduced.

10 Claims, 4 Drawing Sheets

METHOD FOR CONTROLLING DENSITY OF LIQUID CARRIER IN THE TONER IMAGES

CROSS-REFERENCE TO RELATED APPLICATIONS

This application is based upon and claims the benefit of priority from the prior Japanese Patent Application No. 2000-295271, filed on Sep. 27, 2000; the entire contents of which are incorporated herein by reference.

FIELD OF THE INVENTION

This invention relates to an image forming method, and more particularly concerns an image forming method where an image is formed by superimposing visible toner images of a plurality of colors together on a surface of a latent image recording member with a liquid developer.

BACKGROUND OF THE INVENTION

Being able to obtain high quality images comparable to that of printing (e.g. offset) thanks to extremely fine toner particles of sub-micron in diameter, being able to reduce cost for copying because sufficient image density can be obtained with a small amount of toner, and being able to accomplish energy saving because the toner can be fixed to a copy sheet at a relatively low temperature, etc. are the important advantages of the liquid process type electro-photographic recording apparatus employing a liquid developer, which cannot be realized with dry type one, so that its value has been thought better lately.

There are two methods to form a multicolor image using the electro-photography: one is that both forming a visible image on a photosensitive member and transferring the image from the photosensitive member to a recording medium are carried out separately for each color, and then every visible image of each individual color is deposited in superimposed registration with each other on the recording medium, and another is that a multicolor visible image is formed on a surface of a photosensitive member by developing each color separately and successively, and then the multicolor image is collectively transferred to the recording medium.

A method to transfer a plurality of images collectively is advantageous for forming an image with reference to process speed and accuracy of registration of colors.

In the collective transferring, exposure for forming the next visible image on the visible image of the first color formed in advance is carried out. Because toner particles of about 10 micrometers in diameter are used in the electrophotography with powdered toner, exposure light is dispersed by the toner particles which constitute the visible image of the first color. Therefore the exposure of the photosensitive member for the second color was interfered, so that it was difficult to adopt the collective transferring method as the electro-photographic system using powdered toner. On the other hand, because the liquid process type recording system utilizing liquid developer has little dispersion of light due to the liquid developer even though the liquid developer remains on the photosensitive member, it is possible to expose the surface of the photosensitive member over the visible image of the first color.

Then the inventors have tried to form an image adopting the collective transferring method as the electrophotography utilizing a liquid developer. However the problem has been confirmed that the accuracy of the visible image of the second color to the visible image of the first color deteriorates, although transparency of the visible image of the first color is so high that there is no interference to the exposure for the second color.

As mentioned above, there has been a problem that the accuracy of the image of the second color is inferior to the accuracy of the image of the first color if the collective transferring is adopted in the image forming method utilizing the liquid developer.

BRIEF SUMMARY OF THE INVENTION

One object of the present invention is to provide an image forming method performing the collective transferring which enables to prevent the accuracy of the image of the second color from deteriorating.

An aspect of the present invention is a method to form a visible toner image, in which an electrostatic latent image is formed on an electrostatic latent image recording member, and the electrostatic latent image is developed with a liquid developer comprising liquid carrier and toner particles, the method comprising:

forming a first visible toner image on the surface of the electrostatic latent image recording member by providing the surface of the electrostatic latent image recording member with a first liquid developer containing liquid carrier and toner particles to develop the first electrostatic latent image, removing the liquid carrier existing on the surface of the electrostatic latent image recording member on which the first visible toner image is formed to the extent that the liquid carrier remains by a density of $5.0\times10^{-5}$ g/cm$^2$ to $5.0\times10^{-3}$ g/cm$^2$, forming a second electrostatic latent image by charging and exposing the surface of the electrostatic latent image recording member on which the first developed toner visible image with the remained liquid carrier is formed, and forming a second visible toner image on the surface of the electrostatic latent image recording member by providing the surface of the electrostatic latent image recording member with a second liquid developer containing liquid carrier and second toner particles to develop the second electrostatic latent image.

Another aspect of the present invention comprises:

(a) forming a first color toner image on an electrostatic latent image recording member comprising a cylindrical conductive substrate and a photosensitive layer, comprising,
  (a-1) charging the surface of the photosensitive layer,
  (a-2) exposing on the surface of the photosensitive layer by optical scanning to form an electrostatic latent image, and
  (a-3) forming the first color toner image by developing the electrostatic latent image with a liquid developer having a liquid carrier containing toner particles of the first color, (b) removing the liquid carrier to remove excess liquid carrier from the toner image of the first color containing the liquid carrier on the electrostatic latent image recording member to the extent that the liquid carrier remains by a density of $5.0\times10^{-5}$ g/cm$^2$ to $5.0\times10^{-3}$ g/cm$^2$, (c) forming a toner image of a second color on the electrostatic latent image recording member, comprising, (c-1) charging the surface of the photosensitive layer on which the toner image of the first color is formed, (c-2) exposing the surface of the photosensitive layer by optical scanning to form an electrostatic latent image, and (c-3) forming the second color toner image deposited in superimposed registration with the first color toner image by developing the electrostatic latent image with a liquid developer containing toner particles of the second color, and (d) collectively transferring the first and second color toner images to a transferring member by contacting the photosensitive layer on which the both toner images are formed to the transferring member.

DETAILED DESCRIPTION OF THE INVENTION

Figure 1:
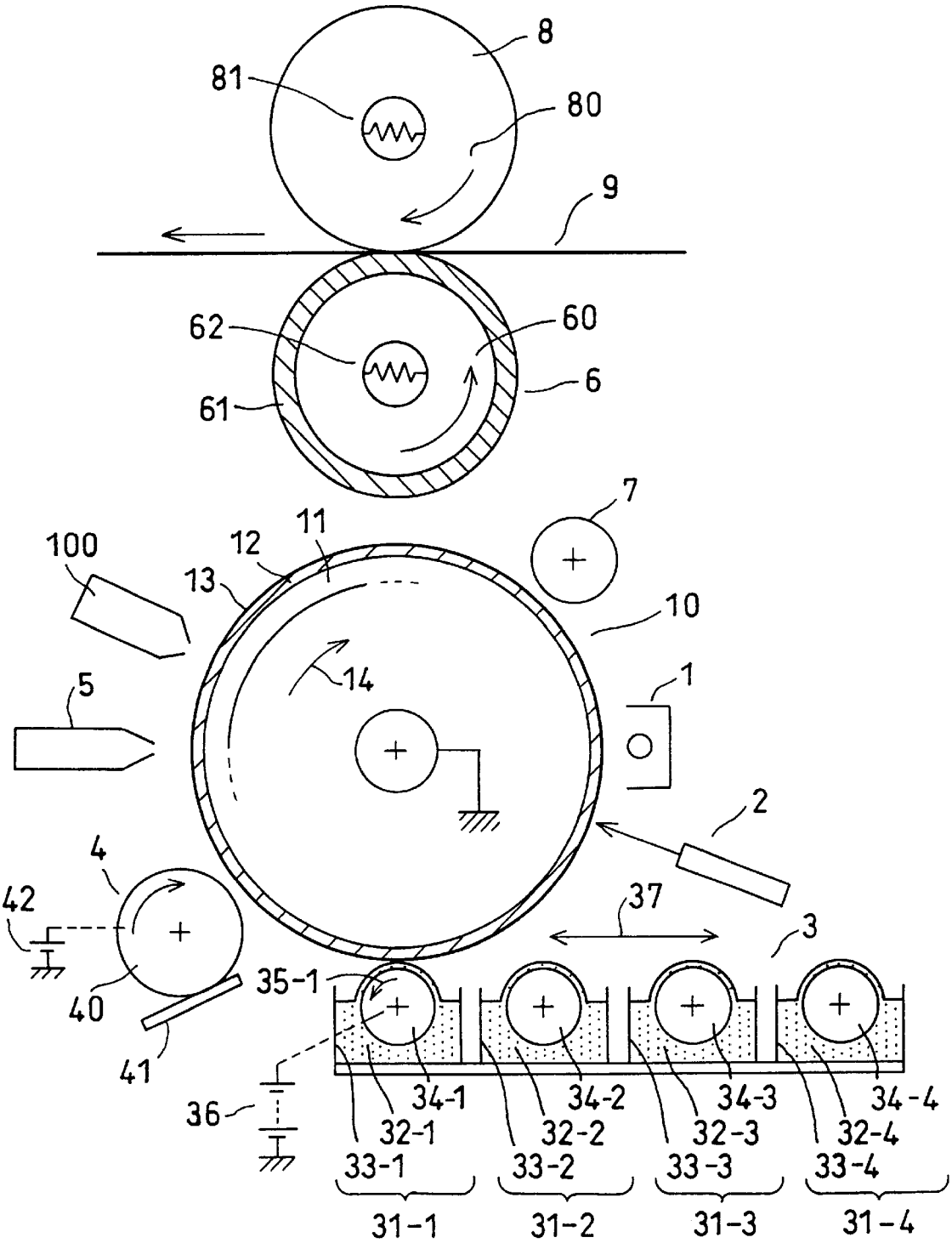
FIG. 1 is a schematic to explain the first Example of the invention.

With reference to FIG. 1, the first embodiment of the invention will be explained.

First, an image forming process to form a first visible image on a surface of a latent image recording member will be explained.

An electrostatic latent image recording member i.e. a photosensitive drum 10 has a photosensitive layer 12 of 10 to 40 micrometers in thickness on a surface of a turnable cylindrical conductive substrate 11 of e.g. aluminum. Furthermore a release layer 13 of 5 micrometers or less in thickness of fluoro-resin or silicone may be formed on the surface of the photosensitive layer 12 to improve exfoliation (transferability) of the visible image when collective transferring to be described later is carried out. The conductive substrate 11 is grounded.

(Formation of electrostatic latent image)

The latent image is formed on the surface of the photosensitive layer 12 of the photosensitive drum by a latent image forming unit comprising a charger and an exposing device 2.

The surface of the photosensitive drum 10 turning in the direction of arrow 14 in the figure is charged uniformly to, for example around +800 volts by a conventional charger 1 such as a corona charger. The charged photosensitive drum is scanned while turning, with a laser beam by means of the exposing device 2 such as a laser oscillator, and consequently the drum is exposed according to the image pattern due to first scanning in optical scanning direction and due to slow scanning in the turning direction of the drum. The exposure discharges the exposed region. For example, the amount of exposure is controlled in order that the charging potential of the exposed region is equal to or less than +200 volts maximum. Thus the electrostatic latent image comprising the exposed region as the imaged region and the non-exposed region as the non-imaged region is formed on the surface of the photosensitive member 12 of the photosensitive drum 10.

(Formation of the first visible image (Development))

Next, the first visible toner image of the first color e.g. yellow is formed on the surface of the photosensitive drum 10 by developing the electrostatic latent image with a first developer 31-1.

The first developer 31-1 comprises a container 33-1 accommodating a liquid developer 32-1, and a roller-like developing electrode (hereinafter called developing roller) 34-1. The liquid developers 32 of the embodiment generally comprise a liquid carrier, toner particles dispersed in the liquid carrier and a charge control agent added to the liquid carrier. For the liquid carrier, isoparaffine, Isopar L (Exxon Corporation) with a specific gravity of 0.767 g/mL is employed. Also, the other material may be any of several hydrocarbon liquids, including hydrocarbons, such as high purity alkanes, e.g. Norpar 12, Norpar 13, and Norpar 15 (Exxon Corporation), and including isoparaffine hydrocarbons such as Isopar G, H, L, and M (Exxon Corporation), Amsco 460 Solvent, Amsco OMS (American Mineral Spirits Company), Soltroi (Phillips Petroleum Company), Pagasol (Mobil Oil Corporation), and Shellsol (Shell Oil Company). The liquid medium is usually present by about 80 to about 99 percent in weight. The toner particles may be of a pigment, or a polymeric material with a pigment or a dye with an average diameter from 0.2 micrometer to 10 micrometers, e.g. 1 micrometer, and be dispersed in the liquid carrier by 0.5 to 5 percent in weight. The charge control agent may be any of metallic soaps, such as Zirconium Naphtenate, and salts of magnesium, calcium and so on may be included in the liquid carrier by 0.01 to 3 percent in weight.

The developing roller 34-1 is located apart from the photosensitive drum by about 150 micrometers, and turns in the direction of arrow 35 in the figure at a surface speed about twice the moving speed of the photosensitive drum 10. As a result, the clearance between the photosensitive member 10 and the developing roller 34-1 is filled with the liquid developer 32-1 carried by turning the developing roller 34-1.

The developing roller 34-1 is supplied with a potential between the potential of the imaged region on the surface of the photosensitive drum 10 and the potential of the non-imaged region thereof, e.g. +600 volts. Consequently, positively charged toner particles existing between the photosensitive drum 10 and the developing roller 34-1 are electrophoresed by the electrostatic force, and selectively attracted to the surface of the imaged region on the photosensitive drum 10. That is to say, the first visible toner image of yellow obtained by developing the electrostatic image with toner particles, is formed on the surface of the photosensitive drum 10. At that time, the potential of the imaged region on the photosensitive drum 10 rises up to around +300 volts, because the positively charged toner particles are stuck thereto.

(Removing the liquid carrier)

Next, a removing method for the liquid carrier from the surface of the photosensitive drum 10 will be explained.

The liquid carrier and the charge control agent therein contained in the first visible toner image are removed from the surface of the photosensitive drum 10.

In FIG. 1, removing by the first squeeze by means of a squeezing unit 4 employing a squeeze roller 40 and removing by the second squeeze by means of an air blower 5 squeezing by blowing of gas are carried out.

The squeeze roller 40 is made of, for example, a metallic cylinder and positioned facing the photosensitive drum 10 with a clearance equal to or narrower than 80 micrometers. The squeeze roller 40 removes the liquid carrier on the surface of the photosensitive drum 10, by conveying mainly the liquid carrier in the top layer thereof from the facing position to the upstream, as fluid squeezing effect operates by turning the roller so as to move at a surface speed about three times the surface speed of the photosensitive drum 10 in the opposite direction thereof at the facing part of the photo sensitive drum 10. In consequence, it is possible to reduce the thickness of the liquid to 1/10 or less with the squeeze roller 40, if for example the liquid carrier of about 30 micrometers in thickness is present at developing operation. The liquid carrier removed by the squeeze roller 40 is collected from the surface of the squeeze roller by a blade 41 located in contact with the squeeze roller.

By supplying the squeeze roller 40 with a predetermined potential by means of a power source 42, the squeeze roller 40 can remove a "fog" which means toner particles exist in non-image area. Namely, by supplying the squeeze roller 40 with a potential of about +600 volts, an electric field from the photosensitive drum 10 toward the squeeze roller 40 generates at the non-imaged part, and then the toner particles, which cannot be electrophoresed as far as the imaged part and thus remain in the non-imaged part, can be collected on the surface of the squeeze roller 40. Consequently so-called 'fog' can be reduced.

The air blower 5 is to supply a gas such as air from a blowing nozzle connected to a pump, etc. to the liquid carrier on the surface of the photosensitive drum 10. The blown gas removes the liquid carrier by gathering it toward mainly the both ends of the photosensitive drum to reduce the thickness of the liquid carrier on the surface of the photosensitive member 10. For example, the liquid carrier with about 1 micrometer thick can be reduced to a half thereof. The charge control agent in the developer can be reduced by this squeezing.

Although a part of the liquid carrier can be removed through the process mentioned above, the liquid carrier remaining on the surface of the photosensitive drum 10 can also be controlled by controlling the amount of removed liquid carrier by means of, for example regulating the turning speed of the squeeze roller 40 or the time for contacting to the blowing gas.

Thus, removing a part of the liquid carrier can improve the accuracy of the visible image of the second color formed thereafter. Especially the effect is remarkable if the remaining quantity of the liquid carrier on the surface of the photosensitive drum is smaller than $5.0\times10^{-3}$ g/cm$^2$. Namely, because the charge control agent in the liquid carrier also reduces,it is possible to prevent that the control agent adheres to the electrostatic latent image and then weakens the electrostatic force for adhesion of toner particles to the image area.

On the other hand, there is a possibility of disturbing partially the electrostatic latent image of the second color, if the liquid carrier on the surface of the photosensitive drum is completely dried up by evaporation. The reason is because the ionized charge control agent or ionized impurities remain locally on the surface of the drum after the liquid carrier evaporated, and they stick to the electrostatic latent image as counter ions. Therefore the liquid carrier is preferably removed so as to remain by very small amount on the surface of the photosensitive drum, and more definitely it is preferable that the liquid carrier is removed so as to remain on the surface of the photosensitive drum by $5.0\times10^{-5}$ gram per square centimeter (g/cm$^2$) to $5.0\times10^{-3}$ gram per square centimeter g/cm$^2$).

(Formation of the second visible toner image)

Next, the second image forming process to form the second visible image will be explained.

In the second image forming process, image forming carried out on the surface of the photosensitive drum 10 is fundamentally the same as the first image forming process except that the former is carried out on the condition that the first visible image has already been formed on the surface of the photosensitive drum 10. Therefore the photosensitive drum 10 returns to the original position after one turn, and all devices except for the development unit can be repeatedly used.

The second liquid developer 32-2 accommodated in the development unit 31-2 used in the second image forming process is different from the first developer in respect of used coloring agent. For example the liquid developer with a coloring agent of magenta is prepared. The developing roller 34-2 and the development unit 31-1 have the same structure as the developing roller 34-1 and the development unit 31-1 respectively.

After the latent image has been formed through the same process as the first image forming process, the second development unit 31-2 moves in the direction of arrow 37 to the position where the first development unit 31-1 was located, and develops the latent image. In consequence, the visible image of magenta (the second visible image) is formed on the toner particles forming the visible image of yellow (the first visible image), deposited in superimposed registration therewith.

After the second visible image has been formed, the liquid carrier in the second liquid developer is removed by the same method as the aforementioned removing method of the liquid carrier.

If the aimed image is a bicolor visible image, transferring process of the visible image to a transferring member 6 is successively carried out. In order to obtain an image with four colors, the third visible image and the fourth visible image are successively deposited in superimposed registration with the first and the second visible images in the same way as mentioned above, on the surface of the photosensitive drum 10 where the first and the second visible images have been formed, by means of the development unit 31-3 with a liquid developer 32-3 of cyan, and the development unit 31-4 with a liquid developer 32-4 of black, and then the transferring process is put in practice.

Figure 2:
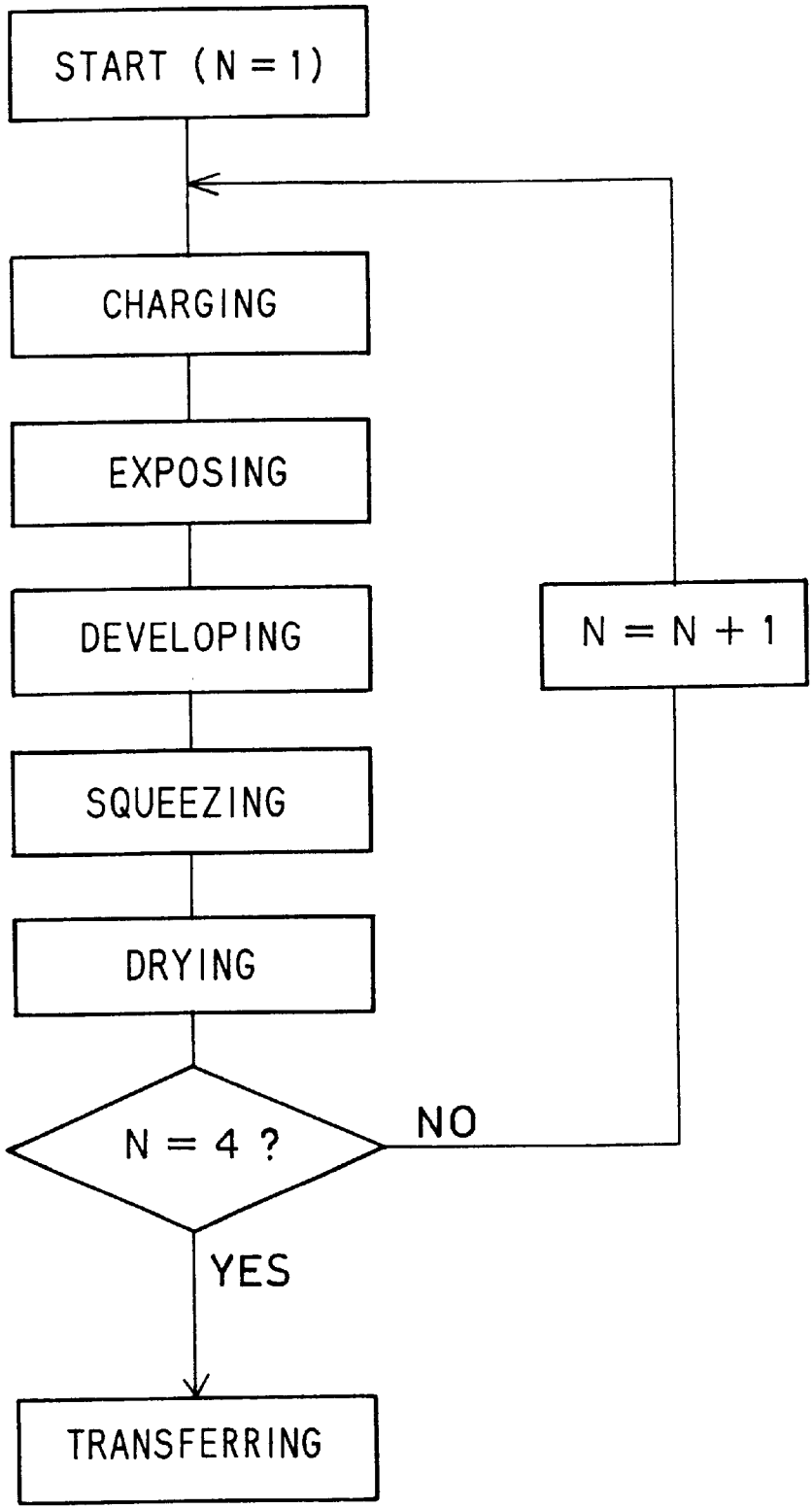
FIG. 2 is a flow chart showing an embodiment of the process of image forming method in accordance with the invention.

FIG. 2 shows the flow chart that sums up the image forming process mentioned above.

That is to say, when a visible image with N colors (N is 4 in this case) is to be formed, image forming for the first color, removing the liquid carrier, image forming for the second color, removing the liquid carrier, image forming for the third color (e.g. cyan), removing the liquid carrier, image forming for the fourth color (e.g. black), and removing the liquid carrier are carried out successively. In the process, more liquid carrier is removed after the fourth color image is formed than after other color images formation by controlling the blower 5 or operating a dryer 100 blowing dried air at a position between the air blow 5 and the intermediate transferring member 6. Consequently the image has less than $1.0\times10^{-4}$ g/cm$^2$ liquid carrier before the next transferring process. After that transferring is carried out.

(Collective transferring)

Next, a transferring process will be explained.

In the present invention, after the visible image with two colors or more has been formed on the surface of the photosensitive drum 10, transferring is put in practice. Hereafter this transferring is referred to as 'collective transferring'.

In FIG. 1, a transferring unit employing an intermediate transferring roller 6 is shown. In the unit, after a multicolor visible image formed on the surface of the photosensitive drum 10 is once collectively transferred to the intermediate transferring roller, the multicolor visible image transferred to the intermediate transferring roller 6 is again collectively transferred to a recording medium.

To put it more definitely, the transferring unit shown in FIG. 1 is constituted of a intermediate roller 6 and a pressing roller 8. The intermediate roller 6 comprises a roller-like member 60, an elastic layer 61 formed on the surface thereof. The pressing roller 8 comprises a roller-like member 80. Both roller has a heater 62(81) inside them.

The intermediate transferring roller 6 stands by at the position where it does not contact the photosensitive drum 10, while the image forming processes from the first color to the third color are being carried out, and then moves so as to be pressed against the photosensitive drum 10 when the image forming process for the fourth color is carried out.

The visible image with four colors formed on the surface of the photosensitive drum 10 through the image forming process for the fourth color, is collectively transferred to the pressed intermediate transferring roller 6 by means of the adhesive force of toner particles.

The pressing roller 8 presses the intermediate transferring roller 6, and a sheet of recording medium such as paper 9 is fed to the pressed region of the pressing roller 8 against the intermediate transferring roller 6.

The visible image collectively transferred to the intermediate transferring roller 6 contacts the fed paper 9 at the pressed part against the pressing roller 8, and then is collectively transferred to the surface of the paper 9 by the adhesive force of the toner particles.

The layer 61 formed on the surface of the intermediate transferring roller 6 is to improve the transferability of the visible image by keeping the contact of the intermediate transferring roller 6 with the photosensitive drum 10, or the contact of the intermediate transferring roller 6 with the pressing roller 8 be sufficiently pressed, and by making the contacted region be wider. The reason why the heaters are installed in the intermediate transferring roller 6 and the pressing roller 8 is to improve the transferring efficiency by heating the toner particles forming the visible image and giving the adhesive property to the toner particles.

Preferably the surface of the intermediate transferring roller 6 is flat and highly exfoliative in order to improve the transferring efficiency from the intermediate transferring roller 6 to the paper 9.

The present invention is not limited to the transferring unit with the intermediate transferring roller using adhesive force, but it can be adopted that a transferring unit directly and collectively transferring an image from a photosensitive drum to a recording medium such as paper, or an electrostatic transferring unit transferring an image by electrophoresing toner particles forming a visible image.

Furthermore, after the image forming process just before the transferring process (the image forming process for the fourth color when a visible image with four colors is to be formed on the surface of the photosensitive drum), removing process of the liquid carrier through squeezing is not always required. For instance, to adopt the electrostatic transferring method, the liquid carrier of more than a predetermined amount is necessary to remain on the surface of the photosensitive drum in the transferring process.

After the transferring process has finished, the first image forming process can be carried out continuously by removing the toner particles which have not been transferred and still remain on the surface of the photosensitive drum 10, with a cleaner 7 as shown in FIG. 1.

The cleaner 7 does not operate before the transferring process, but operates only after the final image forming process has finished and the multicolor visible image has been transferred from the surface of the photosensitive drum 10 with the transferring unit, and consequently the desirable multicolor image can be obtained.

EXAMPLE 1

An output of multicolor image of character samples was obtained on a plain paper as a recording medium with the image forming apparatus described above. However the image consists of only two colors i.e. yellow and magenta. Forming the visible image of yellow, removing the liquid carrier, forming the visible image of magenta, and removing the liquid carrier were successively carried out, and then the bicolor visible image on the surface of the photosensitive drum was transferred to the plain paper with the transferring unit.

Figure 3:
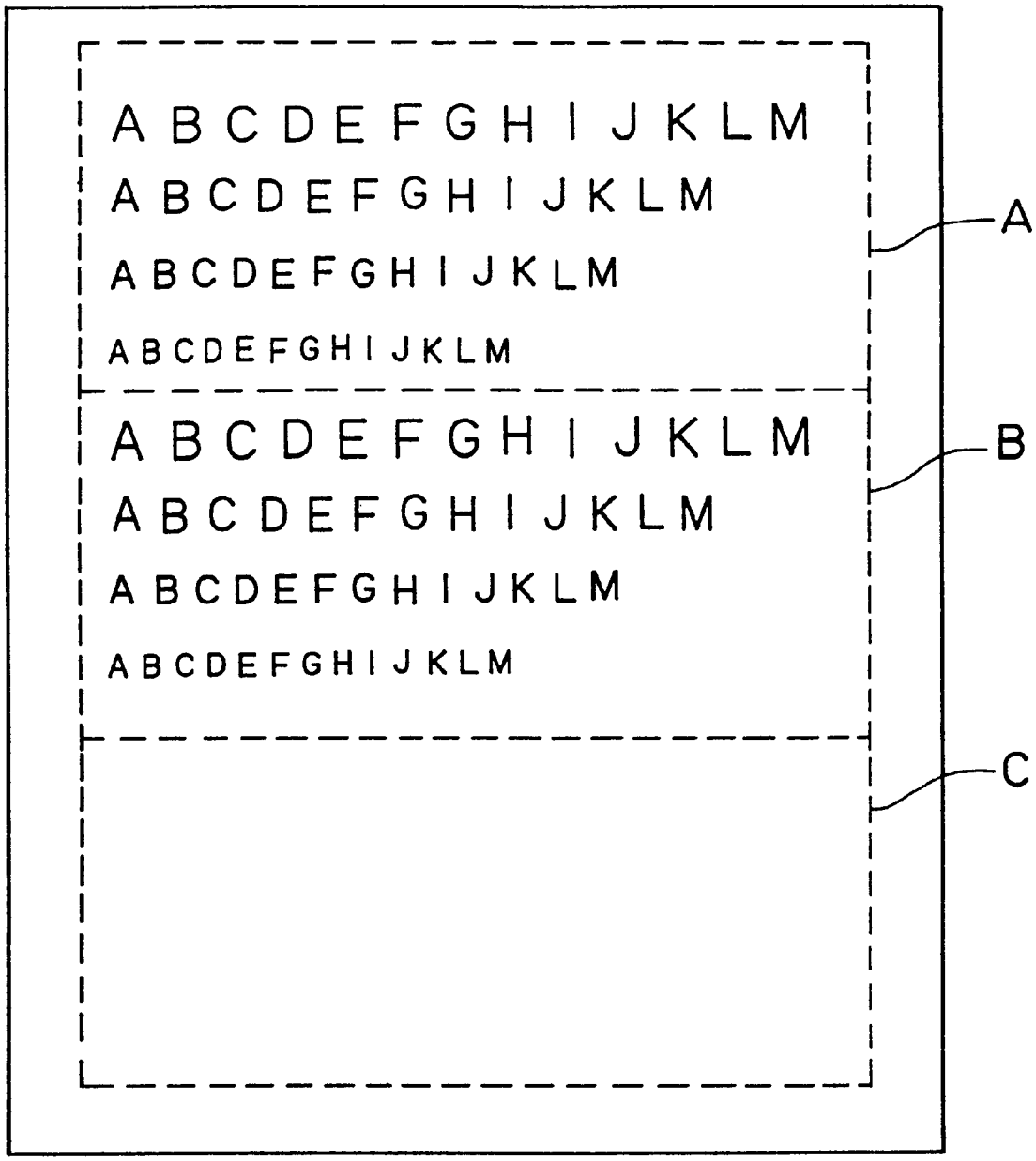
FIG. 3 is a schematic diagram showing the image sample of the embodiment.

FIG. 3 shows the schematic of the character samples used in this embodiment.

As shown in the figure, the yellow image was on the upper one-third region A of the A4 size paper, the magenta image was on the central one-third region B thereof, and the lower one-third region C thereof was blank.

The sizes of the character samples of each color were 8-Point, 6-Point, 4-Point, and 2-Point, and characters of the same size were printed in one line. Here 'Point' is a unit designating the size of a type or a character and defined as 1/72 inch. Therefore 8-Point means a character of 1/9 inch square, and 6-Point, 4-Point, and 2-Point correspond to 1/12 inch square, 1/18 inch square, and 1/36 inch square respectively.

As a result, even the 2-Point characters could be recognized in the obtained image.

After forming the visible image of yellow and removing the liquid carrier had finished, the image forming apparatus was stopped to observe the amount of liquid carrier remaining on the surface of the photosensitive drum. The amount was $2.0\times10^{-4}$ g/cm$^2$. The amount of the liquid carrier was measured by wiping the region of the surface of the photosensitive drum corresponding to the region C in FIG. 3 with a dried web. Namely, difference between the weight of the web before wiping and that after wiping corresponds to the amount of the liquid carrier wiped off, so that the amount of the liquid carrier remaining in the wiped area was measured.

EXAMPLE 2

An output image was obtained according to this embodiment which is the same as the Example 1 except that the quantity of drying gas was a half of the Example 1. The result is shown in Table 1.

The table 1 also shows the amount of the liquid carrier remaining on the surface of the photosensitive drum, measured in the same manner as the Example 1.

EXAMPLE 3

An output image was obtained according to this embodiment which is the same as the Example 1 except that the dryer did not operate. The result is shown in Table 1.

The table 1 also shows the amount of the liquid carrier remaining on the surface of the photosensitive drum, measured in the same manner as the Example 1.

Reference 1

An output image was obtained according to this embodiment which is the same as the Example 1 except that the squeezee roller and the dryer did not operate. The result is shown in Table 1.

The table 1 also shows the amount of the liquid carrier remaining on the surface of the photosensitive drum, measured in the same manner as the Example 1.

Reference 2

An output image was obtained according to this embodiment which is the same as the Example 1 except that the drying gas was warm air and the quantity of the air was twice the Example 1. The result is shown in Table 1.

The table 1 also shows the amount of the liquid carrier remaining on the surface of the photosensitive drum, measured in the same manner as the Example 1.

TABLE 1

| | Remaining amount of the liquid carrier ($g/cm^2$) | Recordable size of the character |
|---|---|---|
| Example 1 | $2.0 \times 10^{-4}$ | 2-Point |
| Example 2 | $4.4 \times 10^{-3}$ | 4-Point |
| Example 3 | $9.2 \times 10^{-3}$ | 8-Point |
| Reference 1 | $5.3 \times 10^{-2}$ | 8-Point |
| Reference 2 | $3.0 \times 10^{-5}$ | 2-Point |

Figure 4:
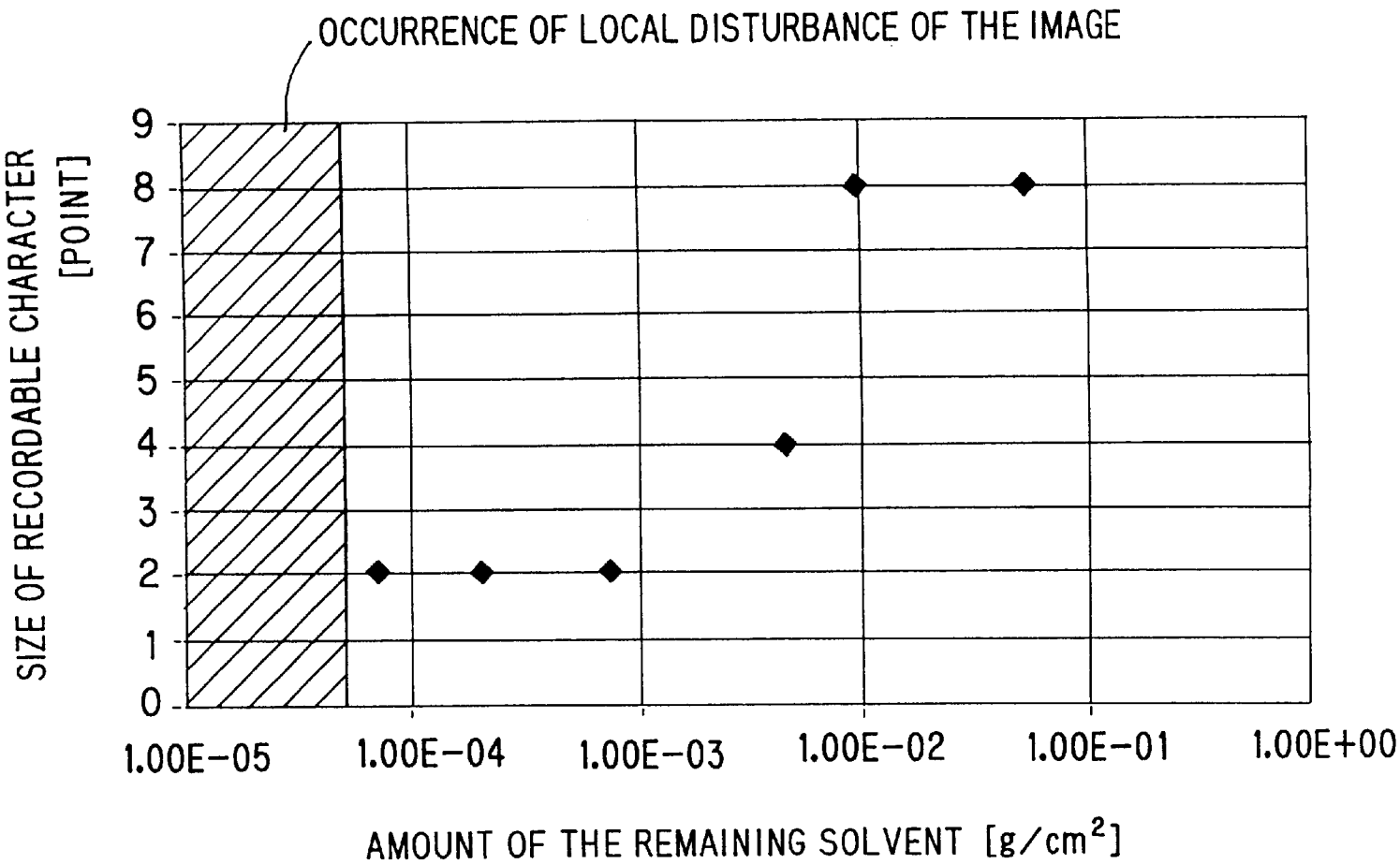
FIG. 4 is a curve showing the readable limit of recorded display for character Point number versus the amount of the liquid carrier in the embodiments.

As shown in Table 1, it will be apparent that the accuracy of the image of the second color is improved by forming the image of the second color on the condition of small amount of the remaining liquid carrier. In Reference 2, although the accuracy of the image was excellent, faint regions of the character images of the second color were found here and there. FIG. 4 shows the results of each embodiment and reference where the horizontal coordinate designates the amount of the remaining solvent, and the vertical coordinate designates the recordable size of character. Moreover, several data other than above-mentioned embodiments and references are plotted for reference. As shown in the figure, the recordable size of character becomes small at the point where the remaining amount of the solvent is around $5.0\times 10^{-3}$ $g/cm^2$, and on the condition that the remaining amount is smaller than the above value, the character of the smallest size (2-Point) can be recorded. Furthermore, it has been confirmed that the character of the smallest size can be stably recorded when the remaining amount is between $1.0\times10^{-4}$ $g/cm^2$ and $1.0\times10^{-3}$ $g/cm^2$.

The reason is as follows:

If toner particles are for example charged positively in the liquid carrier, counter ions (negatively charged ions) are present therein. For instance, metallic soap added in the liquid developer to promote charging of the toner particles, and impurities created in the manufacturing process of toner particles and remaining in the liquid carrier may be counter ionized.

After forming the image of the first color on the surface of the photosensitive drum, the electrostatic latent image for the second color is formed on the photosensitive drum on which ionized metallic soap or impurities exist.

Consequently, it is thought that the potential contrast of the electrostatic latent image decreases because the ions compensate the potential difference in the image, and sharpness of the image gets worse, and then reproduction of dots becomes unstable.

In accordance with the invention, because the liquid carrier on the surface of the photosensitive drum is removed before the image forming process of the second color, quantity of counter ions existing on the surface of the photosensitive drum can be decreased. Thus the electrostatic image of the second color is prevented from being disturbed by the counter ions.

When the liquid carrier is put aside toward mainly the both ends of the drum by air blowing etc., the counter ions as well as the liquid carrier are removed, so that the absolute amount of the counter ions in the liquid carrier decreases, and then the absolute amount of decreasing of charge caused by the counter ions can be diminished. To put aside by air blowing is more effective to reduce further a medium amount of the liquid carrier after being scrubbed by some amount of the liquid carrier by means of the squeeze roller.

On the other hand, if the liquid carrier is completely dried up by evaporation, the counter ions which have not removed and remained, are locally educed on the surface of the photosensitive drum. Therefore it is thought that the electrostatic latent image is remarkably disturbed in the educed region, resulting in partial disturbance of the visible image of the second color, as Reference 2.

In accordance with the invention as mentioned above, these phenomenon disturbing the electrostatic latent image can be prevented by removing at least components of the liquid carrier constituting the liquid developer before the image forming process of the next color, even if a multicolor image is to be formed on the electrostatic latent image recording member with the liquid developer. Thus, formation of pixels stabilizes, and high quality image recording can be accomplished.

What is claimed is:

1. An image forming method to form a visible toner image, in which an electrostatic latent image is formed on an electrostatic latent image recording member, and the electrostatic latent image is developed with a liquid developer comprising liquid carrier and toner particles, the method comprising:

forming a first visible toner image on the surface of the electrostatic latent image recording member by providing the surface of the electrostatic latent image recording member with a first liquid developer containing liquid carrier and first toner particles to develop a first electrostatic latent image, removing the liquid carrier existing on the surface of the electrostatic latent image recording member on which the first visible toner image is formed to the extent that the liquid carrier remains by a density of $5.0\times10^{-5}$ gram per square centimeter ($g/cm^2$) to $5.0\times10^{-3}$ gram per square centimeter ($g/cm^2$), forming a second electrostatic latent image by charging and exposing the surface of the electrostatic latent image recording member on which the first developed toner visible image with the remained liquid carrier is formed, and forming a second visible toner image on the surface of the electrostatic latent image recording member by providing the surface of the electrostatic latent image recording member with a second liquid developer containing liquid carrier and second toner particles to develop the second electrostatic latent image.

2. The image forming method as stated in claim 1, wherein the first liquid developer contains the first toner particles and a charge control agent to charge the first toner particles in the liquid carrier, and the liquid carrier removing process removes the liquid carrier the charge control agent.

3. The image forming method as stated in claim 2, wherein the liquid developer contains an insulated organic liquid carrier, toner particles dispersing in the liquid carrier by 0.5 to 5 in weight percent, with the average diameter of 0.2 to 10 micrometers, and a charge control agent of 0.01 to 3 in weight percent.

4. The image forming method as stated in claim 1, wherein removing the liquid carrier comprises squeezing the liquid carrier by air blowing.

5. An image forming method comprising:

(a) forming a first color toner image on an electrostatic latent image recording member comprising a cylindrical conductive substrate and a photosensitive layer, comprising, (a-1) charging the surface of the photosensitive layer, (a-2) exposing on the surface of the photosensitive layer by optical scanning to form an electrostatic latent image, and (a-3) forming the first color toner image by developing the electrostatic latent image with a liquid developer having a liquid carrier containing toner particles of the first color, (b) removing the liquid carrier to remove excess liquid carrier from the toner image of the first color containing the liquid carrier on the electrostatic latent image recording member to the extent that the liquid carrier remains by a density of $5.0\times10^{-5}$ gram per square centimeter ($g/cm^2$) to $5.0\times10^{-3}$ gram per square centimeter($g/cm^2$), (c) forming a second color toner image on the electrostatic latent image recording member, comprising, (c-1) charging the surface of the photosensitive layer on which the first color toner image is formed, (c-2) exposing the surface of the photosensitive layer by optical scanning to form an electrostatic latent image, and (c-3) forming the second color toner image deposited in superimposed registration with the first color toner image by developing the electrostatic latent image with a liquid developer containing toner particles of the second color, and (d) collectively transferring the first color toner image and the second color toner image to a transferring member by contacting the photosensitive layer on which the both color toner images are formed to the transferring member.

6. The image forming method as stated in claim 5, wherein the (b) and (c) are repeated for forming toner images of a plurality of colors.

7. The image forming method as stated in claim 6, wherein the toner images are of yellow, magenta, cyan, and black respectively.

8. The image forming method as stated in claim 5, wherein the liquid carrier remains by the density of $1.0\times10^{-4}$ gram per square centimeter ($g/cm^2$) or less in a plurality of the toner images deposited in superimposed registration with each other when the toner images are transferred to the transferring member.

9. The image forming method as stated in claim 5, wherein the transferring member is an intermediate transferring member which transfers the both toner images from the electrostatic latent image recording member to a surface of the intermediate transferring member, and transfers the both toner images from the surface of the intermediate transferring member to a copy sheet.

10. The image forming method as stated in claim 5, which further comprises:

removing the liquid carrier kept on the surface of the electrostatic latent image recording member on which the visible toner image developed in advance is formed to the extent that the liquid carrier remains by a density of $10^{-4}$ gram per square centimeter ($g/cm^2$) to $10^{-3}$ gram per square centimeter ($g/cm^2$), and forming an electrostatic latent image corresponding to the next toner image by charging and exposing the surface of the electrostatic latent image recording member on which the developed toner image containing the liquid carrier therein is formed.

* * * * *